US005588360A

United States Patent [19]

Kurz

[11] Patent Number: 5,588,360

[45] Date of Patent: Dec. 31, 1996

[54] TEMPERATURE-CONTROL DEVICE FOR ROTATING BODIES IN PRINTING MECHANISMS

[75] Inventor: Hans-Joachim Kurz, Grossaitingen, Germany

[73] Assignee: Baldwin-Gegenheimer GmbH, Germany

[21] Appl. No.: 206,794

[22] Filed: Mar. 7, 1994

[30] Foreign Application Priority Data

Mar. 11, 1993 [DE] Germany ..... 43 07 732.3

[51] Int. Cl.[6] ..... B41F 13/22

[52] U.S. Cl. ..... 101/212; 101/424.1; 101/487

[58] Field of Search ..... 101/212, 487, 101/424.1

[56] References Cited

U.S. PATENT DOCUMENTS

| | | | |
|---|---|---|---|
| 2,268,987 | 1/1942 | Hess et al. | 101/424.1 |
| 3,628,454 | 12/1971 | Eberly, Jr. | 101/147 |
| 4,879,951 | 11/1989 | Yoshida et al. | 101/363 |
| 5,074,213 | 12/1991 | Kurosawa | 101/487 |
| 5,177,975 | 1/1993 | Mertens | 101/487 |
| 5,178,064 | 1/1993 | Kerber et al. | 101/487 |

FOREIGN PATENT DOCUMENTS

| | | |
|---|---|---|
| 0480230 | 9/1991 | European Pat. Off. . |
| 4000912 | 5/1991 | Germany . |
| 55-31915 | 3/1980 | Japan . |
| 56-127457 | 10/1981 | Japan . |

OTHER PUBLICATIONS

Wasserloser Offsetdruck, *Offsetdrucktechnik, "Eine breite Einführung des wasserlosen Offsetdrucks erfordert innovative Lösungen,"*, W10 Deutscher Drucker, Nr. 46/Oct. 12, 1992. (Article, No Translation).

*Primary Examiner*—Edgar S. Burr
*Assistant Examiner*—Anthony H. Nguyen
*Attorney, Agent, or Firm*—Ostrolenk, Faber, Gerb & Soffen, LLP

[57] ABSTRACT

A temperature control device for rotating bodies in printing mechanisms. It contains a blowing device having an internal air recirculation circuit for the recirculation of cold air which has been deflected from the rotating body which is to be cooled. A cold air generator is arranged outside the blowing device and is connected for flow to it via a cold air feed line. In this way, energy for the production of cold air is saved and the cold air feed line can have a smaller cross section since only a reduced amount of cold air need be fed.

14 Claims, 5 Drawing Sheets

TEMPERATURE-CONTROL DEVICE FOR ROTATING BODIES IN PRINTING MECHANISMS

BACKGROUND OF THE INVENTION

The present invention relates to a temperature-control device for rotating bodies in printing mechanisms, particularly to a blowing device which blows cold air onto the rotating bodies and more particularly to air recirculation means included in the blowing device.

One such temperature control device, but without the recirculation, known from Japanese Patent Application No. S 55-31915, Publication No. S 56-127 457, is used for cooling inking rolls of printing machines for waterless offset printing. Cooling air fed from a cooling unit is blown from a blow box onto one or more inking rolls. The blow box is open on its side associated with the inking roll and is provided with suction openings along the inner side of its edge. The cold air which is blown out is drawn off via the suction openings and is circulated over the cooling unit.

EP-A1-0 480 230 discloses a temperature controller for a printing form for waterless offset printing which is placed around a printing form cylinder. A blow box is provided for blowing air conditioned or cooled air against the printing form. A fan and a cooler are located within the blow box for cooling the blast air produced by the fan. The cooler is supplied with coolant from a cooling system that is arranged outside the blow box. Furthermore, there is a regulator which controls the cooling of the cooler as a function of a temperature.

SUMMARY OF THE INVENTION

The object of the invention is to provide a temperature control device for rotating bodies, in particular printing cylinders or inking rolls or rubber blanket cylinders of a printing mechanism, which device requires less energy for producing the cooling air, while at the same time tubes of hoses of smaller diameter may be required for feeding the cooling air from the generator of the cold air to the blowing device than are required with the known air temperature control device mentioned above.

This object is achieved in accordance with the invention which relates to a temperature control device for rotating bodies in printing mechanisms. It contains a blowing device having an internal air recirculation circuit for the recirculation of cold air which has been deflected from the rotating body which is to be cooled. A cold air generator is arranged outside the blowing device and is connected for flow to it via a cold air feed line. In this way, energy for the production of cold air is saved and the cold air feed line can have a smaller cross section since only a reduced amount of cold air need be fed.

Not only the cold air fed to the blowing device by a cold air generator but also the cold air reflected by the rotating body in question has a lower temperature than air of the outside atmosphere of the printing mechanism. The recirculation and reuse of the deflected air directly at or in the blowing device has the advantage that the blowing device need be supplied with less fresh cold air in order to achieve a given cooling effect. This saves energy that is used for the production of cold air. It furthermore has the advantage that conduits of a smaller cross section of flow than in the device known from Japanese Publication No. S 56-127 457 can be used for feeding cold air from the cold air generator to the blowing device. In the known device, to be sure, cold air which has been blown out is also drawn away. But that is air returned, not to the blowing device, but instead to the cold air generator for renewed cooling. In addition to large conduit cross sections for feeding the cold air from the cold air generator of the blowing device, the known device also has the disadvantage that the air fed back to the cold air generator is heated over a relatively long path of flow by the outside atmosphere or the cold air generator requires conduits provided with good thermal insulation. On the other hand, the air deflected by the rotating body returns over a very short path to the blowing device.

The vacuum necessary for drawing off the blown air is produced, in accordance with the invention, by a vacuum region formed in the blowing device. The vacuum region can be produced by a blower which is contained in the blowing device and which accelerates the stream of fresh cold air in the direction towards the outer surface of the rotating body to be cooled. In another embodiment, as an alternative to or in addition to the above noted blower in the blowing device, a Venturi channel is formed through which the cold air flows, thereby producing a vacuum in accordance with the Venturi principle. This vacuum draws off the cold air which has been blown out and deflected by the rotating body and returns the air through the vacuum region of the Venturi channel into the feed stream of cold air.

The cold air generator produces cold air of a temperature which is dependent on another temperature or a desired value. Thus, the cold air is cooled by the action of the surrounding air to a given cold air value, which can also be referred to as temperature control. Furthermore, upon the start up of a printing mechanism, the rotating body onto which the cold air is blown can have a lower temperature than the cold air as long as the printing mechanism has not yet reached its operating temperature. In such case, the rotating body in question is heated by the cold air. In waterless offset printing, the best printing results are obtained when the operating temperature of the printing form which is arranged on the circumferential surface of a printing cylinder is 25° C. or less.

The temperature control device of the invention is particularly suited for the temperature control or cooling of printing cylinders in waterless offset printing. The temperature control device of the invention can, however, also be used during wet printing for additionally cooling the printing cylinder or the rolls in the inking mechanism of a printing mechanism, or for cooling of a rubber blanket cylinder. Furthermore, it is possible, in accordance with the invention, to use the temperature control device of the invention in addition in other cooling systems in a printing mechanism in order to be able to use the different temperature control or cooling systems optionally, either alternately or simultaneously without the printing mechanism or parts thereof having to be changed when shifting from one type of operation to another.

Other objects and features of the invention are described below with reference to the drawings, which show several embodiments as examples.

DETAILED DESCRIPTION OF THE PREFERRED EMBODIMENTS

Figure 1:
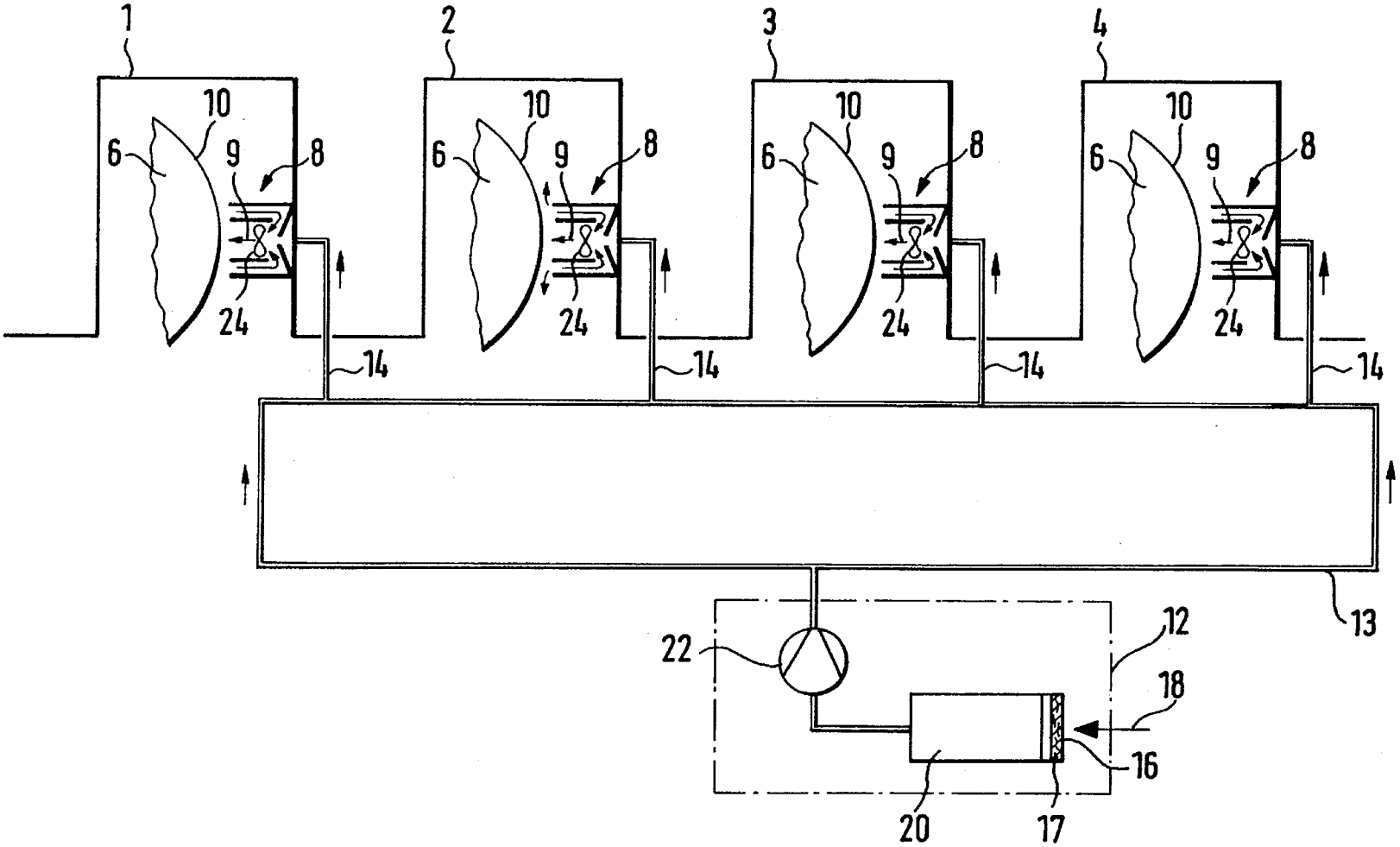
FIG. 1 shows a temperature control device in accordance with the invention for a plurality of rotating bodies of several printing mechanisms having an internal recirculation circuit for cold air.

The temperature control devices shown in FIG. 1 each serves for cooling one rotating body 6, for example a printing cylinder, in four printing mechanisms 1, 2, 3 and 4. The drawing is not to scale, the rotating bodies 6 being shown much too large as compared with the printing mechanisms 1, 2, 3 and 4 so that the drawing is clearly legible. A blowing device 8 associated with each rotating body 6 blows cold air 9 onto the outer surface 10 of the rotating body 6. Cold air is produced by a cold air generator 12 and is fed via cold air feed lines 13 and 14 to all of the blowing devices 8. The cold air feed lines comprise a main distributor line 13 and branch lines 14 off the line 13. The cold air generator 12 contains, in the direction of air flow, in succession, an air inlet 16 having a filter 17 for drawing in and filtering fresh air 18, a unit 20 comprised of a cooler as a heat exchanger and of a cooling unit for providing the cooler or heat exchanger with cooling agent, and a blower 22 for conveying the cold air via the cold air feed lines 13 and 14 to the blowing devices 8.

The cooling action of cold air 9 on the outer surface 10 of each rotating body 6 can be controlled or regulated by changing the temperature of the cold air and/or by changing the speed of conveyance of the cold air as a function of a desired value. The desired value can be the temperature of, for instance, the outer surface 10 of the rotating body 6 or of the cold air or of the cooling agent which cools the cold air. Furthermore, the desired value can be a variable value which is stored, for instance, in a computer control system in the form of a control curve. The speed of conveyance of the cold air can be set and changed by the blower 22 of the cold air generator 12 and/or by a blower 24 arranged in the blowing device 8.

Figure 3:
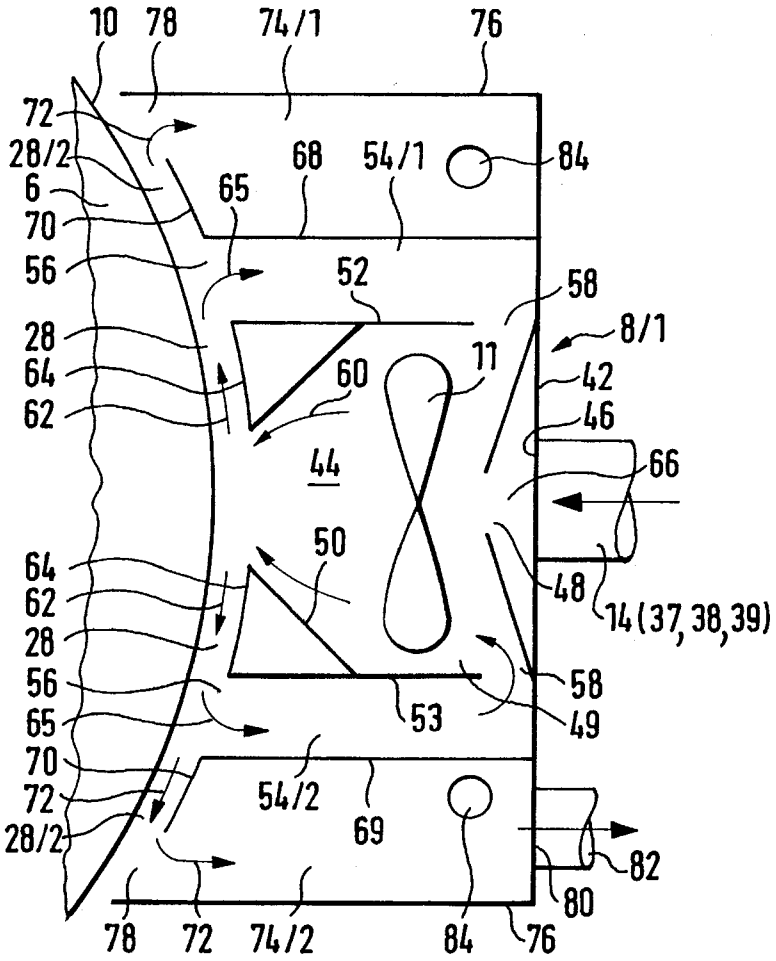
FIG. 3 schematically shows a preferred embodiment of a blowing device for the temperature control devices of FIGS. 1 and 2.
Figure 4:
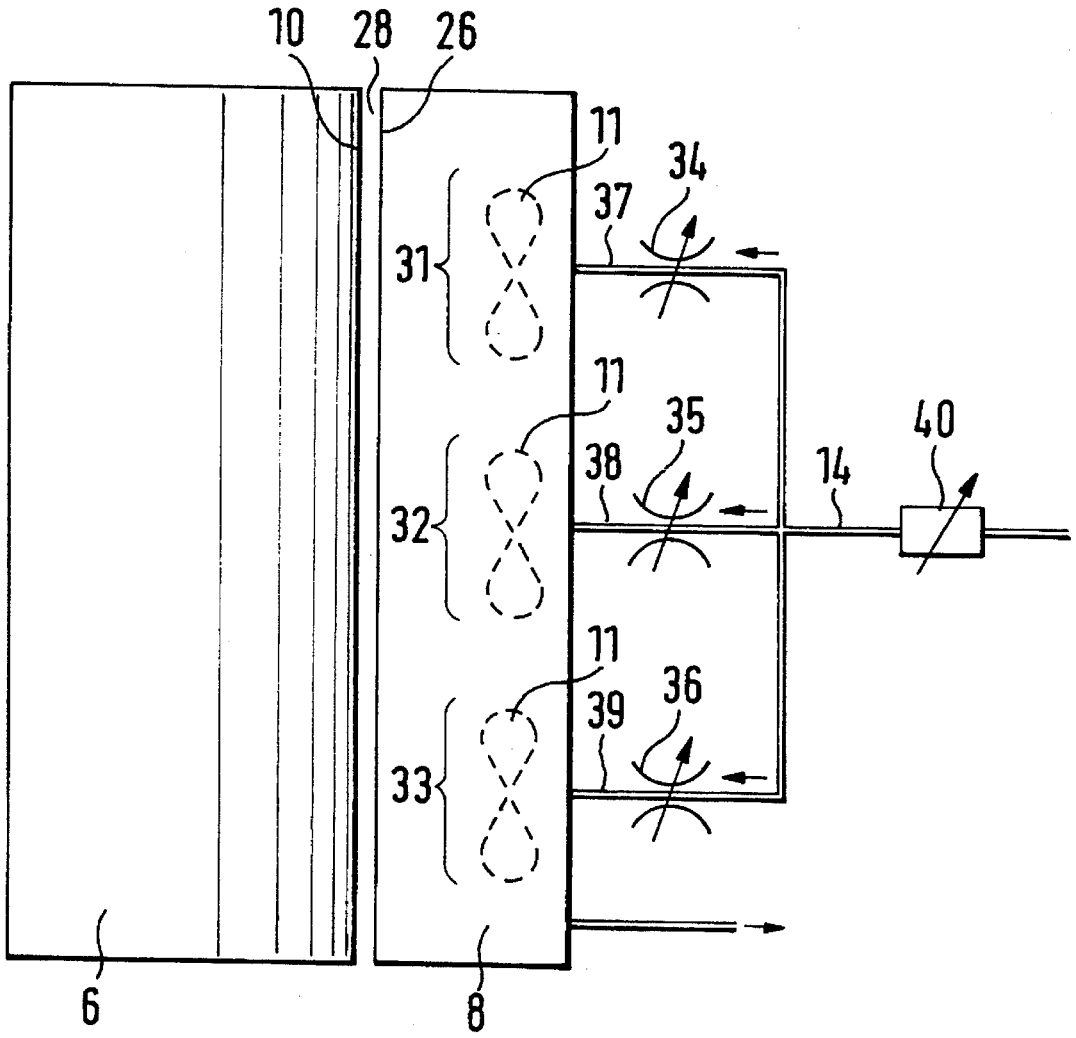
FIG. 4 is a top view of a part of the temperature control devices of FIGS. 1 to 3.

A further embodiment of the blowing device 8 of FIG. 1 is shown in FIG. 3 and designated 8/1 therein. In FIGS. 3 or 4, the blowing device 8/1 or 8 has the shape of a box which extends substantially over the entire axial length of the rotating body 6 (FIG. 4), is open on one side toward the rotating body 6 (FIG. 3) and forms on its edges 26 a narrow spacing slot 28 with the outer surface 10 of the rotating body 6.

As shown in FIG. 4, the blowing device 8 may contain several blowers 11 distributed over the length of the rotating body 6. Each blower 11 is arranged in a different respective cooling zone 31, 32 and 33 distributed over the length of the rotating body 6. In each cooling zone, the cooling action of the cold air can be adjusted individually by changing the velocity of flow of the cold air or by changing the temperature of the cold air. The velocity of flow can be adjusted by adjusting the speed of rotation of the blower 11 or by displacing adjustable flow throttles 34, 35, 36 individually. The flow throttles 34, 35 and 36 are located in cooling zone feed lines 37, 38 and 39, which extend from the branch line 14 to the cooling zones 31, 32 and 33. A pressure regulator can be contained in the corresponding branch line 14. In accordance with a modified embodiment, not shown, it is also possible to convey cooling air from the cooling air generator 12 over separate cooling air lines to the individual cooling zones 31, 32 and 33. The cooling action can then be regulated or controlled by individually changing the temperature of the cold air for the separate zones.

In FIG. 3, the blowing device 8/1 comprises a box 42 in which there is a blow air channel 44 directed radially to the outer surface 10 of the rotating body 6. The channel 44 has a cold air inlet 46 into which the cold air feed lines 14 feed cold air in accordance with FIG. 1, or their cooling zone feed lines 37, 38 and 39, as in FIG. 4, discharge radially to the rotating body 6. Downstream of its cooling air inlet 46, the blow air channel 44 has an inlet section 48 which is constricted in nozzle shape, which is followed by a widened channel section 49, and thereafter by an outlet section 50 which is constricted in a nozzle shape. The constricted outlet section 50 accelerates the stream of cold air, so that it impinges with high velocity on the outer surface 10 of the rotating body 6. The inlet section 48 which is also constricted in nozzle shape also accelerates the stream of cold air. This accelerated stream of cold air through inlet section 48 produces a vacuum or reduced air pressure in the widened channel section 49, according to the Venturi principle. The blower 11 is arranged in the widened channel section which further accelerates the stream of cold air. Above and below the blow air channel 44 and separated by a partition 52 and 53, there are first return channels 54/1 and 54/2 which, together with the blow air channel 44, form a first recirculation circuit. Each of the first return channels 54/1 and 54/2 has an upstream inlet 56 opposite the outer surface 10 of the rotating body 6 and a downstream outlet 58 in the widened channel section 49 directly downstream of the nozzle shaped inlet section 48, but upstream of the blower 11 in the blow air channel 44. The cold air flow 60 in the blow air channel 44 is deflected by the outer surface 10 of the rotating body 6. The cold air then escapes in the form of leakage flows 62 through the gaps 28 between the outer surface 10 and the downstream edges 64 of the walls 52 and 53 of the blow air channel 44. A substantial part 65 of the cold air leakage stream 62 is drawn in by the vacuum or reduced pressure produced in the widened channel section 49, by the Venturi principle, and by the blower 12 through the first return channels 54/1 and 54/2 in this widened channel section 49 and the leakage stream is admixed with the cold air feed stream 66.

Figure 5:
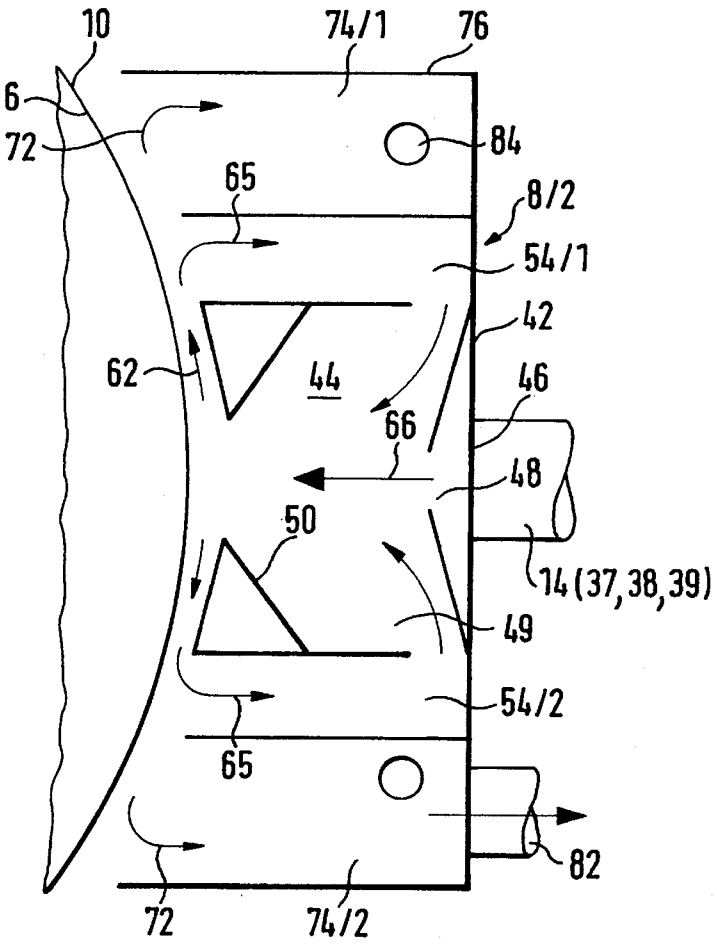
FIG. 5 schematically shows another embodiment of a blowing device of a temperature control device according to the invention.

A further embodiment of a blowing device 8/2 is shown in FIG. 5. It has the same development as the embodiment shown in FIG. 3, but does not include a blower 11. Therefore, the entire feed power for conveying cold air is produced by the blower 22, shown in FIG. 1, of the cold air generator 12.

Returning to FIG. 3, the first return channels 54/1 and 54/2 are defined by outer channel walls 68 and 69, each of which extends parallel to and is spaced from the inner channel walls 52 and 53. They have radially inner edge plates 70 which lie opposite and are spaced from the outer surface 10 and form a downstream continuation 28/2 of the slot 28.

Figure 2:
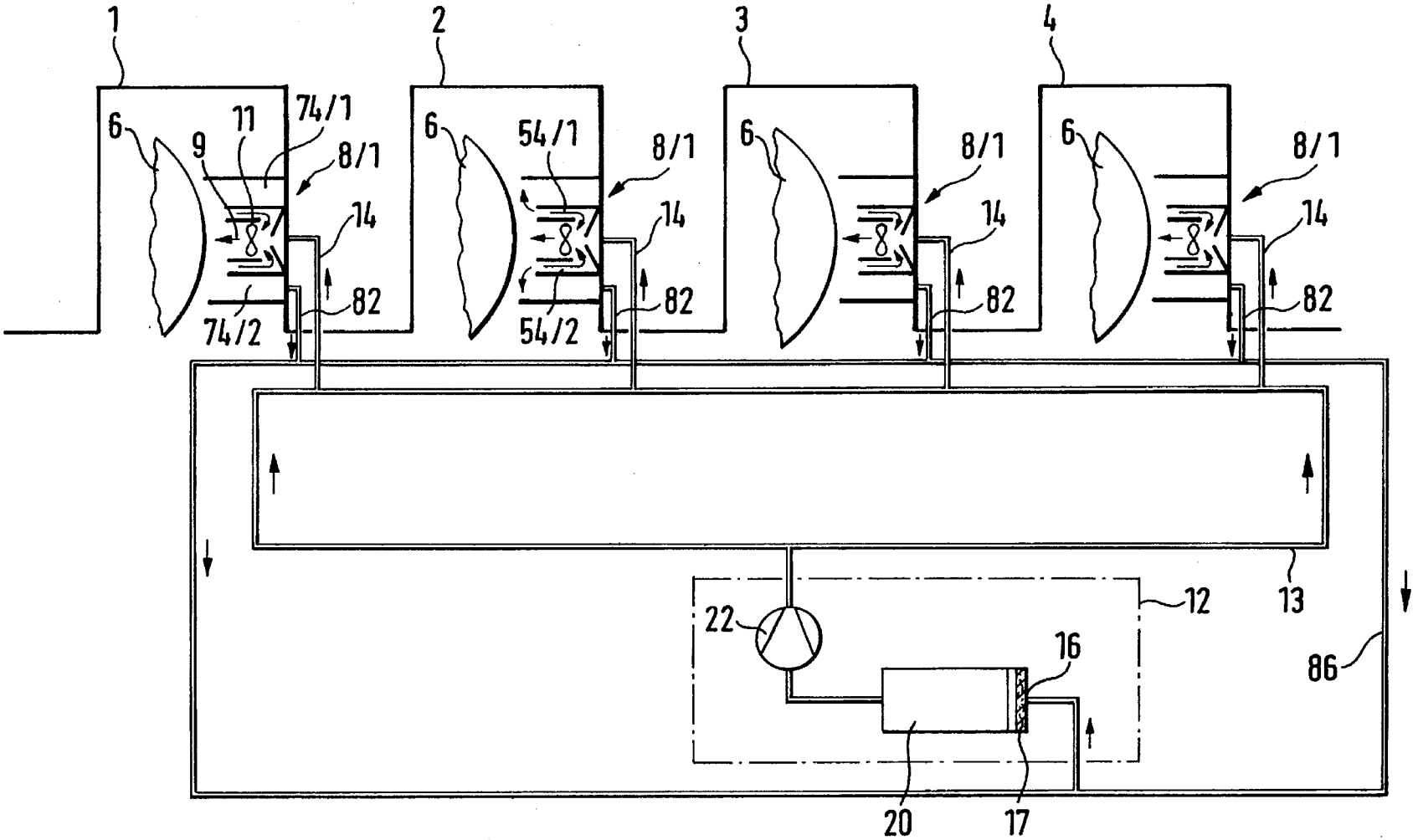
FIG. 2 shows another embodiment of a temperature control device in accordance with the invention for rotating bodies in several printing mechanisms having an internal recirculation circuit and an external recirculation circuit for cold air.

The part 72 of the cold air leakage stream 62 which is not drawn off through the first return channels 54/1 and 54/2 escapes through the slot sections 28/2 and is drawn off substantially into second return channels 74/1 and 74/2. The second return channels 74/1 and 74/2 are formed by the channel walls 68 and 69 of the first return channels 54/1 and 54/2 and by an upper and lower box wall 76 respectively, and the channels 54/1 and 54/2 each have an inlet 78 opposite the outer surface 10. Those channels are connected for flow at their downstream outlet 80 via a suction line 82 to the air inlet 16 of the cold air generator 12, as is shown in FIG. 2. The vacuum of the second return channels 74/1 and 74/2 necessary for drawing off the stream of leakage air 72 is produced by the blower 22 of the cold air generator 12. The two second return channels 74/1 and 74/2 are connected to each other for flow by a channel 84. However, in a modified embodiment, a separate suction line 82 could be connected to each second return channel. If several printing mechanisms in accordance with FIG. 2 are connected to a common cold air generator 12, the suction lines 82 from each printing mechanism can be connected individually or in accordance with FIG. 2 via a common suction line 86 to the air inlet 16 of the cold air generator 12.

The suction force supplied by the blower 22 can be made so strong that no cold air can escape from the box 42, with the entire remaining cold air leakage stream 72 being drawn off over the second return channels 74/1 and 74/2. Together with the cold air generator 12 and the cold air feed lines 13 and 14 they form an outer second air recirculation circuit.

The embodiment of FIG. 2 shows the identical blower device 8/1 of FIG. 3 in the individual printing mechanisms 1, 2, 3 and 4. In the embodiment according to FIG. 1, the outer second air recirculation circuit is absent and the blowing device 8 shown in FIG. 1 therefore does not have second return channels 74/1 and 74/2, but only has the first return channels 54/1 and 54/2.

Figure 6:
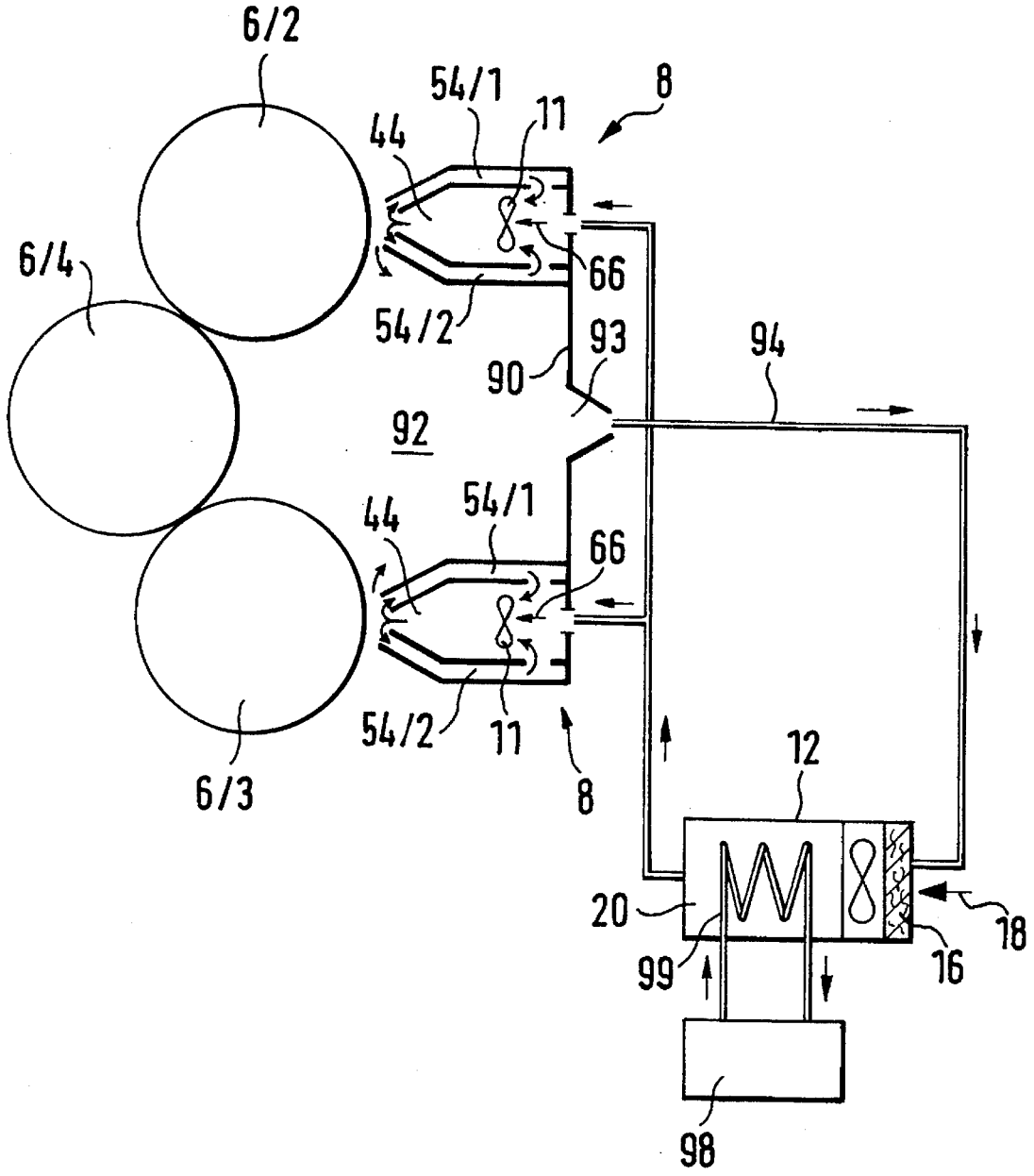
FIG. 6 is a diagrammatic side view of another embodiment of a temperature control device for rotating bodies in printing mechanisms in accordance with the invention.

In the embodiment of FIG. 6, two blowing devices 8 are provided. Each is directed against a different rotating body 6/2 and 6/3. The devices 8 are connected to each other by a wall 90. The two rotating bodies are, for instance, printing cylinders of a printing mechanism. Both bodies rest against a common rubber blanket roll 6/4. These three rotating bodies 6/2, 6/3 and 6/4 could also be inking rolls of a printing mechanism. Together with the two blowing devices 8 and their common wall 90, the rolls define an intermediate space 92. The space 92 is connected for flow via at least one outlet opening 93 and a suction line 94 connecting it to the air inlet 16 of an external cold air generator 12. The space 92 corresponds in function to the second return channel 74/1 or 74/2 of FIG. 3 and forms, together with the suction line 94 and the cold air generator 12, a second or outer air recirculation circuit. This circuit is present in addition to the first air recirculation circuits with the first return channels 54/1 and 54/2 of the two blow devices 8 of FIG. 6.

As shown in FIG. 6, the heat exchanger or cooler 20 of the external cold air generator 12 is passed through by air and also by cooling agent which flows from a cooling system 90 through cooling agent lines 99 to the heat exchanger and then back to the cooling system 98. The cooling agent may be water or coolant which is cooled in the cooling system by compression followed by expansion. Heat exchange between the coolant and the air takes place in the heat exchanger 20.

In all embodiments, the blowing device 8, 8/1 or 8/2 may contain guide plates or throttle flaps for regulating the flow.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A temperature control device for rotating bodies in a printing mechanism, which bodies include at least one of printing cylinders, inking rolls and rubber blanket cylinders, the temperature control device comprising:

a blowing device having a generally box shape, having a length along the axis of the associated rotating body and extending circumferentially partly around the rotating body, and being shaped for blowing a stream of cold air through the blowing device and onto the outer surface of the rotating body substantially over the entire length of the body;

means for generating cold air, including an air inlet for air to be chilled by the generating means and an air outlet for cold air;

a blower for blowing cold air in the stream through the blowing device, the blower being connected with the air outlet from the generating means for receiving cold air therefrom;

a first air recirculation circuit in the blowing device including a first cold air return channel having an inlet region near the rotating body and placed so as to draw cold air which has been blown onto and then deflected by the rotating body away from the rotating body, and the first return channel being shaped to direct the cold air back into the stream of cold air being blown through the blowing device;

means for producing a vacuum region in the blowing device along the stream of cold air blowing through the blowing device toward the rotating body, and the vacuum region communicating with the first return channel for drawing recirculated cold air back into the stream of cold air.

2. The temperature control device of claim 1, further comprising a second air recirculation circuit including a second cold air return channel for drawing off part of the cold air which escapes along the outer surface of the rotating body past the inlet region of the first return channel and means for drawing off the air through the second return channel.

3. The temperature control device of claim 2, wherein the means for drawing off air through the second return channel comprises the second return channel being connected to the air inlet to the cold air generating means.

4. The temperature control device of claim 1, wherein the means for producing a vacuum region comprises a blower disposed in the blowing device at a location for blowing the cold air on the rotating body, and the first return channel communicating back into the stream of cold air at a location along the stream of air before the blower in order for the vacuum produced in the blowing device to draw the recirculating air through the first return channel.

5. The temperature control device of claim 1, wherein the means for producing a vacuum region comprises the blowing device having a hollow cone shape, wherein the air from the generating means blowing through the blowing device creates a vacuum affect on the first return channel.

6. The temperature control device of claim 4, further comprising a plurality of the blowing devices arrayed along the length of the rotating body and the blowing devices being individually adjustable for adjusting the blowing of cooling air at locations along the rotating body corresponding to the locations of the respective blowing devices.

7. The temperature control device of claim 1, further comprising a plurality of the blowing devices arrayed along the length of the rotating body and the blowing devices being individually adjustable for adjusting the blowing of cooling air at locations along the rotating body corresponding to the locations of the respective blowing devices.

8. The temperature control device of claim 7 wherein the cold air generating means is connected in common to all of the blowing devices.

9. The temperature control device of claim 2 wherein the second return channel has a second inlet region for drawing off the cold air and the second return channel inlet region is opposite the rotating body at a point along the deflected cold air path which is located further downstream than the first inlet region, and the first inlet region is also directed for receiving cold air that has been deflected by and around the rotating body.

10. The temperature control device of claim 2 wherein the blower in the blowing device is adapted for accelerating the flow of cold air directed onto the rotating body.

11. The temperature control device of claim 1 wherein the blower in the blowing device is adapted for accelerating the flow of cold air directed onto the rotating body.

12. The temperature control device of claim 11 wherein the blowing device includes a nozzle section for the cold air which narrows in the direction of the air stream toward the rotating body for accelerating the cold air stream, the nozzle section having an outlet directed toward and located directly opposite the rotating body.

13. The temperature control device of claim 1, further comprising a second blower in the cold air generating means for conveying the cold air toward the blowing device.

14. In combination, a plurality of the temperature control devices of claim 1 each associated with a respective one of the rotating bodies and the cold air generating means being connected with each of the blowing devices of each of the temperature control devices.

* * * * *